US006418635B1

(12) United States Patent
Nelson et al.

(10) Patent No.: US 6,418,635 B1
(45) Date of Patent: Jul. 16, 2002

(54) PAGE MAKER TEMPLATE

(75) Inventors: Toni Nelson, Placentia; Beth Reames, Orange, both of CA (US)

(73) Assignee: EK Success, Ltd., NJ (US)

( * ) Notice: Subject to any disclaimer, the term of this patent is extended or adjusted under 35 U.S.C. 154(b) by 0 days.

(21) Appl. No.: 09/390,969

(22) Filed: Sep. 7, 1999

(51) Int. Cl.[7] ..... B43L 13/20

(52) U.S. Cl. ..... 33/563; 33/566; 434/87; D10/64; D19/40

(58) Field of Search ..... 33/562, 563, 566, 33/1 G, 564, 565, 613, 645; 434/85, 87; D10/64; D19/35, 37, 40

(56) References Cited

U.S. PATENT DOCUMENTS

| | | | | | |
|---|---|---|---|---|---|
| 306,869 | A | | 10/1884 | McMaster | |
| 332,148 | A | | 12/1885 | Goldsmith et al. | |
| 1,087,326 | A | | 2/1914 | Seehase et al. | |
| 1,633,163 | A | | 6/1927 | Crouse | |
| 1,879,624 | A | * | 9/1932 | Lockwood | 33/563 |
| 1,899,318 | A | | 2/1933 | Dixon | |
| D134,627 | S | | 3/1942 | Harrison | |
| 2,293,696 | A | * | 8/1942 | Burchell | 41/34 |
| 2,334,913 | A | | 11/1943 | Eisenberg | 164/78 |
| D137,340 | S | | 2/1944 | Lozier | |
| D146,285 | S | | 1/1947 | Musgrave | D52/1 |
| 2,487,673 | A | | 11/1949 | Roper | 33/174 |
| D156,504 | S | * | 12/1949 | Grant | 33/563 |
| 2,950,537 | A | | 8/1960 | Fixen | 33/174 |
| D192,383 | S | | 3/1962 | Rogers | D52/6 |
| 3,156,984 | A | | 11/1964 | Palmer | 33/189 |
| D200,595 | S | | 3/1965 | Herman et al. | D52/6 |
| 3,557,463 | A | | 1/1971 | Perry et al. | 33/174 |
| 3,568,327 | A | | 3/1971 | Furuoka | 33/174 |
| 3,633,286 | A | * | 1/1972 | Maurer | 434/87 |
| 3,696,529 | A | * | 10/1972 | Mabbutt | 434/87 |
| 3,699,660 | A | | 10/1972 | Siegel | 33/174 |
| D270,647 | S | | 9/1983 | Fisher | D19/39 |
| 4,736,526 | A | | 4/1988 | Hsia | 33/565 |
| 4,828,497 | A | * | 5/1989 | Kurgan | 434/96 |
| 4,837,939 | A | | 6/1989 | Pullen | 33/562 |
| 4,936,020 | A | | 6/1990 | Neblett | 33/566 |
| 4,998,355 | A | * | 3/1991 | Greene | 33/667 |
| D348,406 | S | | 7/1994 | Sun | D10/71 |
| 5,396,713 | A | | 3/1995 | Valdez | 33/565 |
| 5,533,900 | A | * | 7/1996 | Volk | 434/87 |
| D378,756 | S | | 4/1997 | McDonald et al. | D15/136 |
| D398,865 | S | | 9/1998 | Diettrich et al. | D10/62 |
| 6,112,425 | A | * | 9/2000 | Nelson et al. | 33/566 |

* cited by examiner

*Primary Examiner*—Christopher W. Fulton
(74) *Attorney, Agent, or Firm*—Sofer & Haroun, LLP

(57) ABSTRACT

A template for guiding an implement on a design page, such as a scrapbook page. The template has a first plurality of interior edges defining shapes and a second plurality of interior edges defining borders around the shapes. The first and second pluralities of interior edges are configured on the template so as to provide a layout that is transferrable to the design page. According to one embodiment, the interior edges are configured on the template so as to provide a layout which is transferrable to the design page without having to reposition the template. The layout is employed, according to one embodiment, to arrange display objects, such as photographic or hand-drawn pictures, on the design page. In one embodiment, the template has a third plurality of interior edges defining slots, which are employed to guide a user in writing captions corresponding to the displayed objects.

9 Claims, 2 Drawing Sheets

PAGE MAKER TEMPLATE

FIELD OF THE INVENTION

This invention relates generally to art supplies, and more particularly to templates for designing layouts for scrapbook pages.

BACKGROUND OF THE INVENTION

Template stencils are well-known in the art as guides for artists who seek to draw or cut pre-determined shapes. A template usually comprises a semi-rigid piece of plastic, having a small thickness. The face of the template can have a variety of different voids or cut-outs. The interior cut-outs are given their shape by the interior edges of the template, which guide the writing instrument of a user along the path proscribed by the edge of the template. The template is placed upon a sheet desired to be drawn upon (hereinafter "a design page"). The user draws along the interior edges of the template and a drawn line is created on the design page coinciding with the shape or pattern which the interior edge of the template possessed.

It is typically a desired attribute of a stencil template to provide, without increasing the relative size of a stencil template, the greatest variety of shapes possible for the user. An increase in efficiency will exist if a single stencil template can provide a user with numerous shapes and patterns to implement. Therefore, as much of the template as possible should consist of interior edges for the user to be guided by. However, the stencil must also retain its semi-rigidity so as not to be easily broken during normal usage and not to have its interior edges deflect, and thereby cause the writing instrument to deviate from the edge's proscribed path, if the user's writing instrument pushes against the edge during usage. Therefore, a balance must be struck to provide the user with the maximum number of edges which define shapes or patterns while still retaining the semi-rigidity of the template.

Prior art templates usually provide interior edges that define various designs. The designs are typically configured on the template so as to require a user to reposition the template on the transfer surface in order to align various shapes. For instance, U.S. Pat. No. 1,633,163 to S. P. Crouse discloses a drafting implement for those desiring to make diagrammatic sketches of localities, such as intersecting streets, the location of tracks and buildings, as well as the location of manholes, posts, obstructions, etc. The interior edges which guide the drafting implement of the user are configured such that the template must be repositioned each time a new object is desired to be sketched.

U.S. Pat. No. 2,334,913 to Eisenberg discloses a corner and border making stencil for mounting pictures. The stencil is rectangular in shape and has obliquely directed strip portions extending across the inside corners. These obliquely directed strip portions are positioned for guiding the cutting of slits across an album page. A user can then mount a picture by its corners by inserting the corners of the picture through the cut slits.

U.S. Pat. No. 3,156,984 to J. V. Palmer discloses a template for picture framing mats, that locates the interior corners of equal or mixed width margin picture mats. The template has a V-shaped notch that mates with the corner of the mat. The template also has a plurality of perforations that receive pins for marking the mat. Once the mat has been marked with pinholes, the pins and the template are removed from the mat and the interior edges of the mat may be drawn and then cut. Alternatively, once the pins and the template have been removed, another drafting implement with a long, straight edge may be lined up with the pinholes to guide a cutting implement.

U.S. Pat. No. 3,557,463 to C. R. Perry et al. discloses a loose leaf stencil folder for layout design, having a loose leaf binder that folds out to three binder elements. Each binder element has stencil templates of various shapes and sizes held in the binder by hinges or rings. A user may selectively fold any of the stencil templates over a drawing board and draw the shape defined by the stencil onto the drawing board. Thus, a user often repositions a template or else removes and replaces one template with another.

U.S. Pat. No. 4,837,939 to Pullen discloses a template for marking or cutting a shaped corner on a workpiece. The template has a series of different shaped corner templates that attaches to a main body portion. The main body portion also has side edges which abut the edges of a workpiece, allowing the corner template to be positioned on the corner of the workpiece and to be used as a guide for marking or cutting the corner.

Finally, U.S. Pat. No. 4,936,020 to Neblett discloses a template for marking a picture mat in preparation for cutting the mat. The template has two planar arms having graduation lines that when lined up with the edges of the mat permit layout marks to be traced to the mat from the inside edge of the template. Various decorative corners may be cut in the mat by aligning the template in several different positions and by marking and cutting the mat accordingly However, the devices disclosed by these references require a user to re-position the template when arranging a layout on a design page. Thus, there exists a need for an improved template.

SUMMARY OF THE INVENTION

According to one embodiment, the present invention relates to a template for guiding an implement on a design page, such as a sheet of paper or scrapbook page. The template has a first plurality of interior edges defining shapes, a second plurality of interior edges defining borders around the shapes, and, in another embodiment, a third plurality of interior edges defining slots. The first, second and third pluralities of interior edges are configured on the template so as to provide a layout which can be transferred to the design page. According to one embodiment of the invention, the interior edges are configured so as to provide a layout that can be transferred to the design page without repositioning the template. The layout is employed, according to one embodiment, to arrange display objects, such as photographic or hand-drawn pictures, on the design page.

Preferably, the first plurality of interior edges are employed to draw a line on the display object in the shape defined thereby. The drawn line can then be used to guide a cutting implement, such as a pair of scissors or a knife, to crop the display object (e.g.—trim the photograph or picture) into the desired shape. The second plurality of interior edges that define borders around the shapes are ideally configured to guide an implement so as to create decorative pen lines around the shaped display object, but preferably, are also configured to guide an implement so as to form one or more mats for the shaped display object. Furthermore, in one embodiment, the slots defined by the third plurality of interior edges are employed to guide a user in writing captions corresponding to the display objects that are arranged on the design page according to the transferred layout.

Additionally, according to one embodiment of the present invention, the template has outer edges and corners which may also be employed to transfer decorative designs to the edges and corners of the design page. According to one embodiment, the implement guided by the template is a writing implement, such as a pen, which is employed by a user to draw the layout of the template onto the design page.

BRIEF DESCRIPTION OF THE DRAWING

The present invention will be further understood from the following description with reference to the accompanying drawing, in which.

DETAILED DESCRIPTION OF THE INVENTION

Figure 1:
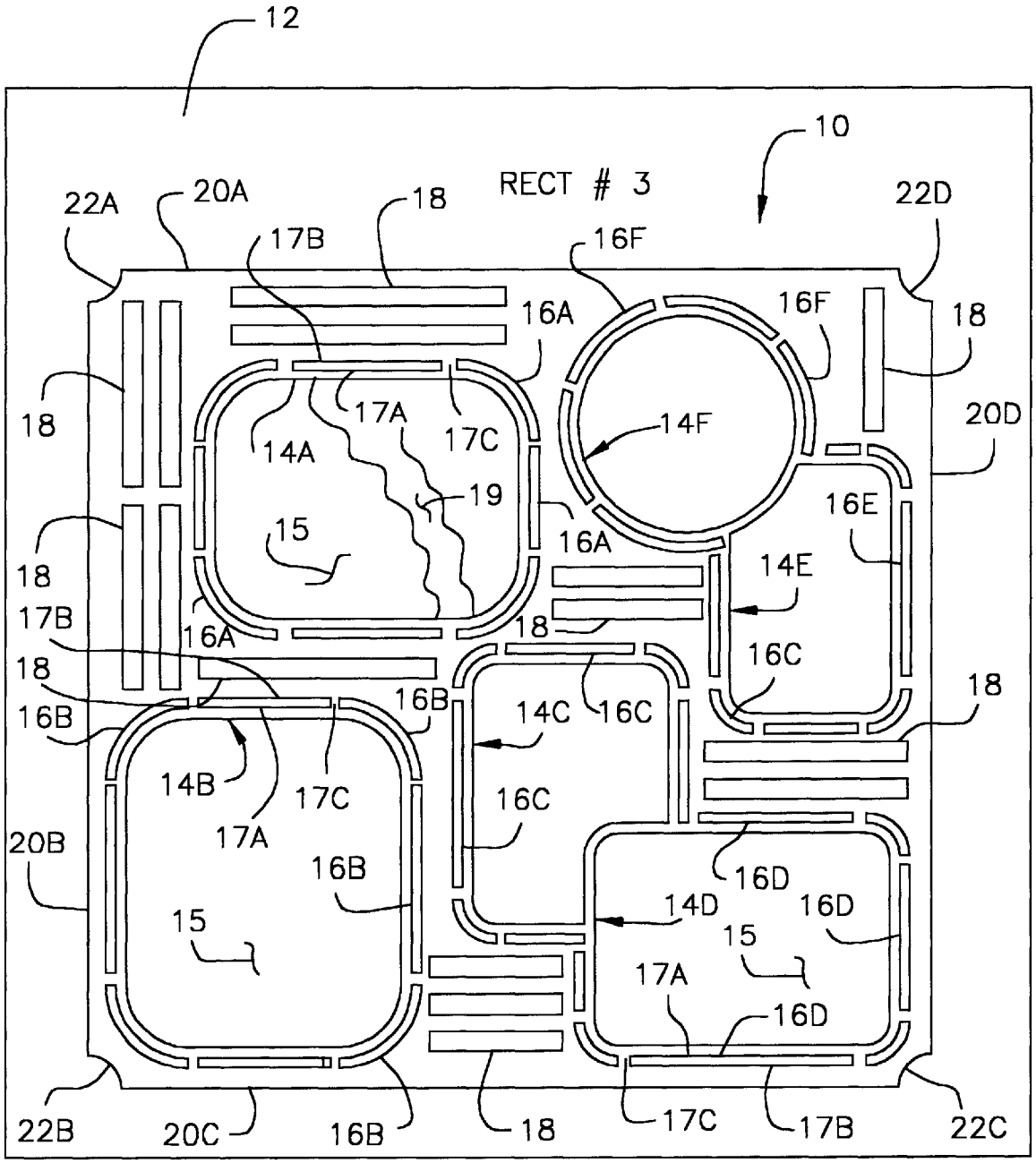
FIG. 1 illustrates a template, in accordance with one embodiment of the invention.

FIG. 1 illustrates one example of a preferred embodiment of the present invention, also referred to as a "Plan-A-Page" ® template. Template 10 is a sheet of semi-rigid material, preferably plastic, of varying size, though preferably approximately 11" long, 11" wide and 1/32" thick. According to another embodiment, template 10 has a size which is approximately 11" long and 8½" wide. Although the present invention contemplates the use of templates having any size, the above-referenced sizes are preferred because they conform to the approximate size of a typical page in a scrapbook. Preferably, template 10 is see-through or clear, to facilitate the easy placement of photos, mats, etc. Ideally, template 10 is configured so as to be employed in conjunction with the Border Buddy template system as shown and described in Applicant's co-pending U.S. patent application Ser. No. 09/109,469, which is incorporated by reference herein as fully as if set forth in its entirety.

Template 10 has a plurality of discrete voids defined by interior edges 14. The interior edges 14 defining the voids comprise various shapes and sizes, but all serve the purpose of permitting a user to trace along the interior edge to create a shape on design page 12 identical with the shape of the void in template 10. Design page 12 may be any surface desired to have transferred thereon the shapes defined by template 10, but is preferably a scrapbook page or other type of paper.

Preferably, though not necessarily, the interior edges 14 of template 10 provide a layout of different shapes. The layout on template 10, when transferred to design page 12, preferably provides an aesthetically pleasing arrangement for the placement of display objects on design page 12. These display objects may comprise photographic or hand-drawn pictures, or any other display object that a user may desire to place on design page 12. According to one embodiment, the entire layout is transferrable from template 10 to design page 12 without having to reposition template 10. Thus, template 10 may be employed to guide an implement to draw lines on display objects or mats so that they can be cut into desired shapes and be positioned on the design page according to the layout provided by template 10. It is noted that, while only one layout is shown in FIG. 1 (explained in detail below), template 10 may employ an infinite number of different layouts.

FIG. 1 illustrates a first plurality of interior edges 14 of template 10 that define shapes. These shapes may be transferred to design page 12 for providing an arrangement of objects, as previously described. For instance, interior edges 14*a* through 14*e* define rectangular shapes which are employed to trim a photograph or other display object in a rectangular size suitable for display. Interior edge 14*f* defines a circular shape. According to the embodiment shown, several of the interior edges are positioned such that they overlap, such as interior edge 14*c* which overlaps interior edge 14*d*, and interior edge 14*e* which overlaps interior edge 14*f*. It is noted, however, that the present invention is not limited in scope by the number of, the size of, nor the shapes defined by interior edges 14. In addition, the present invention is not limited in scope by any particular configuration of shapes defined thereby.

FIG. 1 also illustrates a plurality of interior edges 16 that border the shapes defined by interior edges 14. By transferring interior edges 16 to design page 12, a decorative border can be provided for the photographic or hand-drawn pictures which were laid out on design page 12 according to interior edges 14. For instance, interior edges 16*a* provides a decorative border around the transferred shape defined by interior edge 14*a*, while interior edges 16*b* provides a decorative border around the transferred shape defined by interior edge 14*b*. In one embodiment, the decorative border is drawn with a writing implement such as a pen or marker.

In another embodiment, interior edges 16 may be employed to create a mat for the object to be displayed. For instance, interior edges 16 have first edges 17*a* and second edges 17*b*. First edge 17*a* of interior edges 16 may be employed to draw a line on a first sheet of paper to be used as a first mat around the display object. Second edges 17*b* may be employed to draw a line on a second sheet of paper to be used as a second mat around the display object. Alternatively, if only a single wide mat is desired to be placed around the display object, second edges 17*b* may be employed to draw a line on a first sheet of paper to be used as a wider first mat. Bridge regions 17*c* are employed to provide stability to template 10 in the regions of edges 16.

In the embodiment shown, wherein the shapes defined by interior edges 14*c* through 14*f* are positioned to overlap, interior edges 16*c* through 16*f* are positioned to provide a decorative border only around that part of the shapes that are not overlapping. It is noted, however, that the present invention is not limited in scope by the number of, the size of, nor the shapes defined by interior edges 16. In addition, the present invention is not limited in scope by any particular configuration of decorative borders defined thereby.

FIG. 1 also illustrates a plurality of interior edges 18 that define slots at various positions between the shapes defined by interior edges 14. While the slots may merely be employed to further decorate design page 12, preferably interior edges 18 are employed in order to provide a guide for writing captions, without having to reposition template 10. For instance, interior edges 18 provide conveniently positioned and aligned slots for a user to write a caption corresponding to the object, such as a photographic or hand-drawn picture, that is laid out according to interior edges 14. It is noted, however, that the present invention is not limited in scope by the number of, the size of, nor the shapes defined by interior edges 18. In addition, the present invention is not limited in scope by any particular configuration of slots defined thereby.

FIG. 1 also illustrates a plurality of exterior edges 20 and corner edges 22 that define the outer edges of template 10. By transferring exterior edges 20 and corner edges 22 to design page 12, a decorative border can be provided for the outer edge regions of design page 12. It is noted, however, that the present invention is not limited in scope by the existence of, nor the shapes defined by exterior edges 20 and corner edges 22. Preferably, the decorative border and corners are drawn with a writing implement such as a pen or marker.

While template 10 comprises numerous shape-defining voids or cut-outs, it is noted that template 10 is constructed with enough of the plastic template material between the cut-outs, and with enough of the plastic template material between the cut-outs and the template edges, so as prevent template 10 from being too flimsy or from breaking during normal usage. It is also noted that template 10 is reversible, wherein it can be flipped over so as to enable the user to draw a mirror image of the configuration of shapes disposed within template 10.

Figure 2:
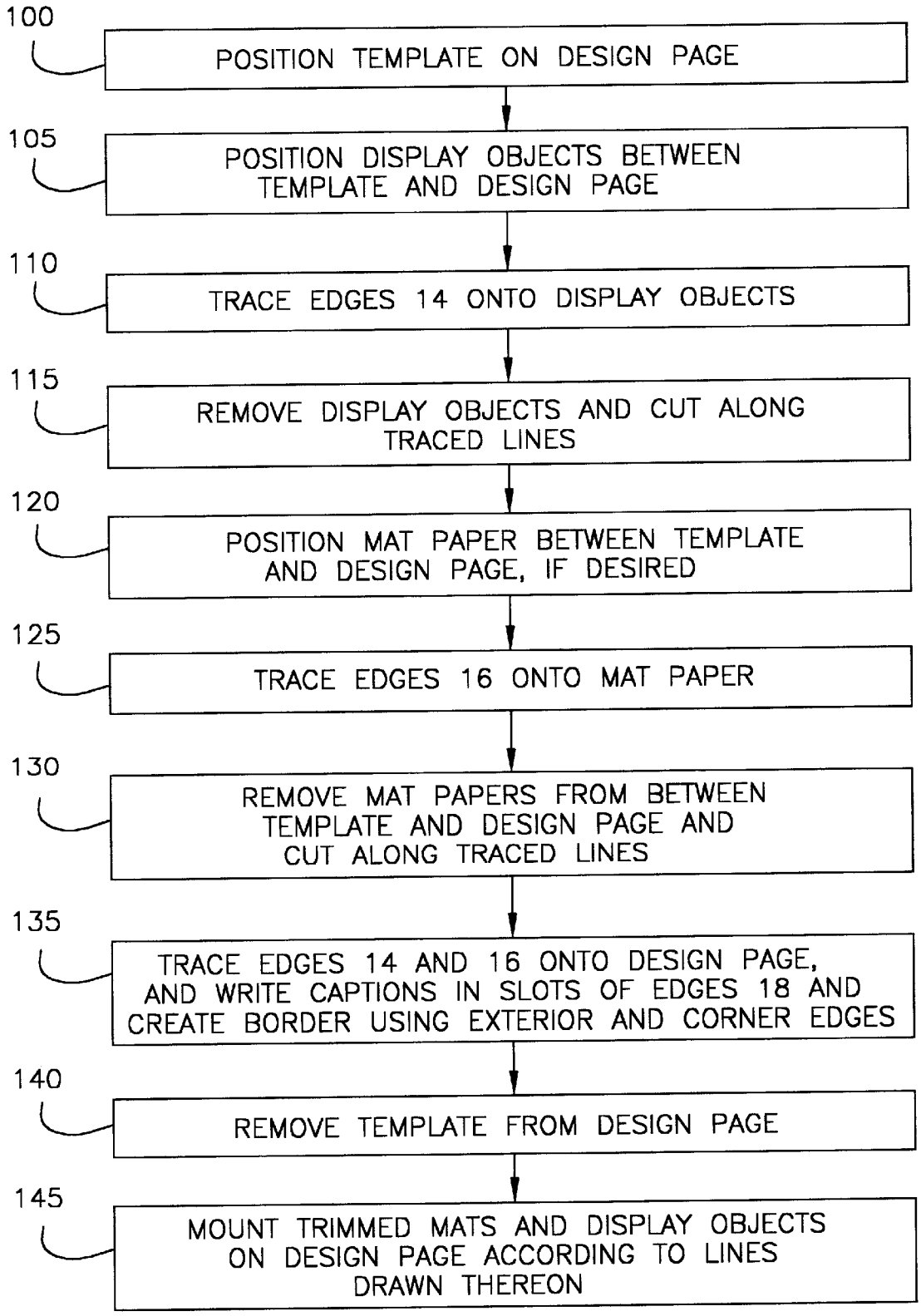
FIG. 2 is a flowchart that illustrates the steps performed by a user of the template to lay out display objects on a design page, in accordance with one embodiment of the invention.

There are many ways in which template 10 may be employed. For instance, FIG. 2 is a flowchart that illustrates the steps performed by a user of template 10 to lay out display objects 15 on design page 12, such as a page from a memory book or album, according to one embodiment of the invention. At step 100, template 10 is positioned by the user on design page 12 so as to be properly aligned thereon. For instance, if template 10 is 11"×11" in size, it may be placed on a 12"×12" scrapbook page with a ½" of space on each side.

At step 105, display objects 15 are positioned between template 10 and design page 12 so that the portion of each display object 15 desired to be displayed on design page 12 shows within interior edges 14. Alternatively, if a larger display area is desired, the user may position each display object 15 to be displayed within first edge 17*a* or second edge 17*b*. At step 110, the user draws lines on display object 15 by guiding a writing implement along interior edges 14 (or first edge 17*a* or second edge 17*b*, if a larger display is desired). At step 115, display objects 15 are removed from between template 10 and design page 12. Display objects 15 are then cut or trimmed along the lines drawn thereon.

At step 120, mat papers 19 are positioned between template 10 and design page 12 so that mat paper 19 shows within interior edges 16. Of course, this step is only performed if the user desires to employ mats around display objects 15, though it is recognized that the user may determine not to employ a mat or to simply draw (according to interior edges 16) a decorative border directly on design page 12 with a writing implement. Assuming that the user does desire to employ mats, after step 120 is performed, the user next performs step 125. At step 125, the user draws lines on mat papers 19 by guiding a writing implement along interior edges 16. At step 130, mat papers 19 are removed from between template 10 and design page 12. Mat papers 19 are then cut or trimmed along the lines drawn thereon.

Steps 120 through 130 may be repeated if more than one mat is desired to be used around display objects 15. For instance, a first mat may be created using first edge 17*a* of interior edge 16 while a second mat may be created using second edge 17*b* of interior edge 16. Alternatively, if only one mat is desired, it may be created by using either first edge 17*a* or second edge 17*b*.

At step 135, after both the display objects 15 and mat papers 19 have been removed from between template 10 and design page 12, the user preferably draws lines on design page 12 by guiding a writing implement along interior edges 14 and 16. Also, if so desired, the user may write captions describing the displayed objects by employing the slots defined by interior edges 18, or may employ these slots to create other decorative designs on design page 12. At step 140, template 10 is removed from between template 10 and design page 12. At step 145, display objects 15 and mat papers 19 which were trimmed in steps 115 and 130 respectively are mounted on design page 12 according to the lines that were drawn thereon at step 135.

Alternatively, if the user does not desire to draw lines on design page 12, steps 135 and 140 may be eliminated. According to this alternative method, template 10 remains positioned on design page 12 after the performance of step 130 and the user positions trimmed mat papers 19 and display objects 15 on design page 10 using template 10.

It is also noted that, while in the preferred embodiment template 10 is employed to trim display objects 15 and mat papers 19, the present invention contemplates the use of template 10 to mount display objects 15 onto design page 12 without cutting them or trimming them. For instance, according to this embodiment, template 10 is positioned on design page 12, display objects 15 are placed between template 10 and design page 12 such that they show within edges 14, and are mounted directly onto design page 12. The user may then employ interior edges 16, 18, 20 and 22 to create decorative borders, write corresponding captions and/or create edge and corner designs. In this embodiment, template 10 provides a layout for the placement of display objects, captions and other decorative designs on design page 12 without having to reposition the template.

While there has been shown and described particular embodiments of the invention, it will be obvious to those skilled in the art that changes and modifications can be made therein without departing from the invention, and therefore, the appended claims shall be understood to cover all such changes and modifications as fall within the true spirit and scope of the invention.

We claim:

1. A method for transferring a layout to a design page, said method comprising the steps of:

positioning a template on said design page, said template comprising a first plurality of interior edges defining shapes, and a second plurality of interior edges defining borders around said shape, wherein said first and second pluralities of interior edges are configured on said template so as to provide a layout transferable to said design page;

positioning display objects between said template and said design page so that said display objects shows within said first plurality of interior edges;

drawing a first set of lines on said display object by guiding a writing implement along said first plurality of interior edges;

trimming said display objects along said first set of drawn lines;

positioning mat paper between said template and said design page so that said mat paper shows within said second plurality of interior edges;

drawing a second set of lines on said design paper by guiding a writing implement along said second plurality of interior edges;

trimming said mat paper along said second set of drawn lines;

positioning said display objects on said design page according to said layout of said template;

positioning said mat paper on said design page according to said layout of said template;

mounting said mat paper on said design page; and mounting said display objects on said design page.

2. The method of claim 1, wherein said second plurality of interior edges further comprise a first edge and a second edge, and said method further comprising the steps of:

positioning two mat papers between said template and said design page so that each said mat paper shows within said second plurality of interior edges;

drawing said second set of lines on one said mat paper by guiding a writing implement along said first edge of said second plurality of interior edges;

drawing a third set of lines on the second said mat paper by guiding a writing implement along said second edge of said second plurality of interior edges;

trimming both said mat papers along said second and third sets of drawn lines;

positioning said mat papers on said design page according to said layout of said template; and mounting both said mat papers on said design page.

3. The method of claim 1, wherein said step of positioning said display objects on said design page according to said layout of said template further comprises:

drawing lines on said design page by guiding a writing implement along said first and second pluralities of interior edges;

positioning said display objects on said design page according to said lines drawn on said design page.

4. The method of claim 1, wherein said step of positioning said display objects on said design page according to said layout of said template further comprises:

maintaining said template in position on said design page;

positioning said display objects on said design page according to said first plurality of interior edges.

5. The method of claim 1, wherein said template further comprises a third plurality of interior edges defining slots, said method further comprising the step of employing said slots to write captions describing said displayed objects.

6. The method of claim 1, wherein said template further comprises a plurality of exterior edges, said method further comprising transferring a shape of said exterior edges to an outer edge region of said design page.

7. The method of claim 1, wherein said template further comprises a plurality of corner edges, said method further comprising the step of transferring a shape of said corner edges to a corner region of said design page.

8. The method of claim 1, wherein said method is employed to transfer said layout to a scrapbook page.

9. The method of claim 1, wherein said method is employed to layout photographs in a scrapbook.

* * * * *